United States Patent [19]

Klapp

[11] Patent Number: 4,645,481

[45] Date of Patent: Feb. 24, 1987

[54] METHOD AND APPARATUS FOR PREVENTING CONTAMINATION BY SPLASHING GLUE IN A CARTON FORMING MACHINE

[75] Inventor: Hartmut Klapp, Kaarst, Fed. Rep. of Germany

[73] Assignee: Jagenberg AG, Dusseldorf, Fed. Rep. of Germany

[21] Appl. No.: 783,378

[22] Filed: Oct. 2, 1985

[30] Foreign Application Priority Data

Oct. 3, 1984 [DE] Fed. Rep. of Germany ..... 3436239

[51] Int. Cl.[4] ..... B31B 3/62; B05C 11/06

[52] U.S. Cl. ..... 493/150; 493/132; 493/281; 493/337; 156/578; 118/63; 118/203; 427/428; 101/416 R

[58] Field of Search ..... 493/83, 132, 150, 279, 493/280, 281, 282, 283, 337; 156/470, 471, 472, 473, 578; 101/416 R, 416 A, 349; 239/433, 434; 118/63, 203, 261; 427/428

[56] References Cited

U.S. PATENT DOCUMENTS

| | | | |
|---|---|---|---|
| 1,957,470 | 5/1934 | Milmoe | 493/337 |
| 2,842,053 | 7/1958 | De Marchi | 101/416 R |
| 2,859,727 | 11/1958 | Phin et al. | 493/150 |
| 3,000,760 | 9/1961 | Greiller | 118/63 |
| 3,320,086 | 5/1967 | Rose et al. | 118/63 |
| 3,339,525 | 9/1967 | Roberts | 118/63 |
| 3,524,758 | 8/1970 | Miller | 118/63 |
| 3,605,585 | 9/1971 | Borders | 493/132 |
| 4,128,668 | 12/1978 | Ernest | 427/349 |
| 4,263,869 | 4/1981 | Wahnschaff | 118/249 |

FOREIGN PATENT DOCUMENTS 2749906 5/1979 Fed. Rep. of Germany .

*Primary Examiner*—Francis S. Husar
*Assistant Examiner*—William E. Terrell
*Attorney, Agent, or Firm*—Sprung Horn Kramer & Woods

[57] ABSTRACT

The invention relates to a method for blowing away particles of glue in a strip-gluing unit for folding box forming machines for gluing box blanks. Compressed air is blown from the side of a gluing disc of the gluing unit at an acute angle obliquely towards the direction of travel of the blank at the height of the nip between the blank and gluing disc so that on account of the high speed of the blanks and gluing disc, particles of glue which are thrown off are removed on the shortest path, without these particles splashing on the blanks and machine parts. The air is blown by an air-guide member, which comprises an air chamber, which is connected by lines to a source of compressed air. Starting from the air chamber is a bore whose axis is directed at the height of a nip at the acute angle. The air-guide member is attached in the folding box sticking machine independently of the gluing unit and is seated laterally beside the gluing disc and serves simultaneously to support the travelling blanks.

8 Claims, 3 Drawing Figures

METHOD AND APPARATUS FOR PREVENTING CONTAMINATION BY SPLASHING GLUE IN A CARTON FORMING MACHINE

BACKGROUND OF THE INVENTION

The present invention relates to a method and an apparatus for blowing away particles of glue in a strip gluing unit for folding box or cartons forming machines, wherein a gluing disc is immersed in a glue bath, glue adhering to the gluing disc is metered by a doctor blade and the glue is applied from below to the adhesive flaps of folding box blanks conveyed past.

In a folding box forming machine of the aforementioned type, the folding box blanks are stacked in a feeder and removed individually therefrom. In the strip gluing unit arranged close behind the feeder, the adhesive flaps are glued and in further stations the blanks are folded around scored lines and at the end are folded together so that the adhesive flaps make contact with the opposite side of the blank. The folding boxes lying flat and folded together in this way also travel overlapped through a pressing station, in which they are held under pressure, so that the glue can set.

Boxes which are produced in this way in modern folding box forming machines, have a high travelling speed. Consequently, the gluing disc of the strip gluing unit must rotate very quickly. Due to the geometry resulting from the rectilinear path of movement of the blanks and that of the circular gluing disc, the stream of glue splits in the nip between the path of movement and gluing disc. As a result of adhesion, one branch of the stream of glue remains stuck to the box, for the same reason another branch remains stuck to the gluing disc. This results in a wedge-shaped area in which the association of particles of glue with one or the other branch is uncertain. On account of the high speed of the blanks and gluing disc, these particles are thrown off in the travelling direction and undesirable splashes of glue occur, which contaminate both the blanks as well as subsequent parts in the folding box forming machine and impair their efficiency or even put them out of action. The electronic glue-checking device is particularly sensitive to contamination, the latter device having to be located close behind the strip-gluing unit for technical reasons. For reasons of the orderly production of folding boxes it is therefore absolutely necessary to prevent splashes of glue from reaching the blanks and parts of the machine.

One method of reducing the number of splashes formed consists of increasing the viscosity of the glue. However, this method does not lead to the desired result, since a large number of splashes still remain, which contaminate the parts. Moreover, increasing the viscosity cannot be taken too far, since excessive viscosity reduces the adhesiveness of the glue.

SUMMARY OF THE INVENTION

The object of the invention consists of deflecting the splashes of glue which inevitably occur so that they are not harmful to the blanks and machine parts. This object is achieved due to the fact that at the height of the nip between the gluing disc and blank, compressed air is blown into the wedge-shaped area of the layers of glue adhering to the gluing disc and blank from a position at the side of the gluing disc.

An apparatus is already known from German PS 27 49 906, in which an air jet receiving compressed air is used, which is directed directly towards the nip between the gluing members, in order to separate the filaments of glue produced in the gluing unit of a labelling machine. The remains of the glue filaments are in this case forced back onto the gluing members. However, an apparatus of this type cannot be used in the present invention since part of the nip is in this case formed by the workpiece, namely the blank and must in no way be contaminated by splashes of glue. Experiments with an air jet directed directly towards the nip have also had the result that apart from the blank, the counter-roller located above the gluing disc is also contaminated after a relatively short operating time so that satisfactory application of glue is no longer guaranteed.

In order that the particles of glue leave the region of the blank and the machine parts along the shortest path, the method according to the invention is furthermore developed so that the compressed air is blown at an acute angle with a component opposing the conveying direction of the blanks. The velocity vector of the compressed air blown at an acute angle and the velocity vector of the particles of glue thrown off in the direction of travel are added together geometrically to give a resultant with which the particles are blown away approximately at right angles to the direction of travel outside the regions of the blanks and machine parts.

It was found that it is advantageous if the blowing angle amounts to between 40° and 70°.

For carrying out the above described method, an apparatus is proposed such that an air-guide member is located at the side of the gluing disc, of which the blowing aperture is directed at the height of the nip between the gluing disc and blank towards the wedge-shaped region of the layers of glue adhering to the gluing disc and blank. An apparatus of this type may be a pipe connected to a source of compressed air, of which the end is provided with a blowing aperture and which is bent at an acute angle with respect to the direction of travel of the blanks. However, in the preferred case, the air-guide member is constructed in the shape of a plate and is equipped with an air chamber connected to a source of compressed air, starting from which chamber is a bore, which points from the side towards the wedge-shaped area, the axis of which forms an acute angle with the line of application of the blank conveying direction, so that a component of the blown air stream is directed in opposition to the conveying direction.

The acute angle which the axis of the bore forms with the direction of travel, is preferably between 40° and 70°.

It is advantageous to be able to leave the air-guide member in its position, even if the strip-gluing unit has to be dismantled, for example for cleaning. Also, the strip-gluing unit has to be located on the side of the gluing disc so that apart from the adhesive flap, where it does no harm, no other surfaces of the blank are sprayed. This is achieved due to the fact that the air-guide member is adjustably attached to the side of the folding box forming machine independently of the strip-gluing unit and is arranged on the side of the gluing disk, which is remote from the adhesive flap.

An additional object of the air-guide member is that of supporting the blanks as they travel. Therefore, the air-guide member comprises a smooth surface, which serves for supporting the blanks conveyed past.

A preferred embodiment of the invention is illustrated in the drawings and described in detail hereafter, in which:

DETAILED DESCRIPTION OF THE INVENTION

Figure 1:
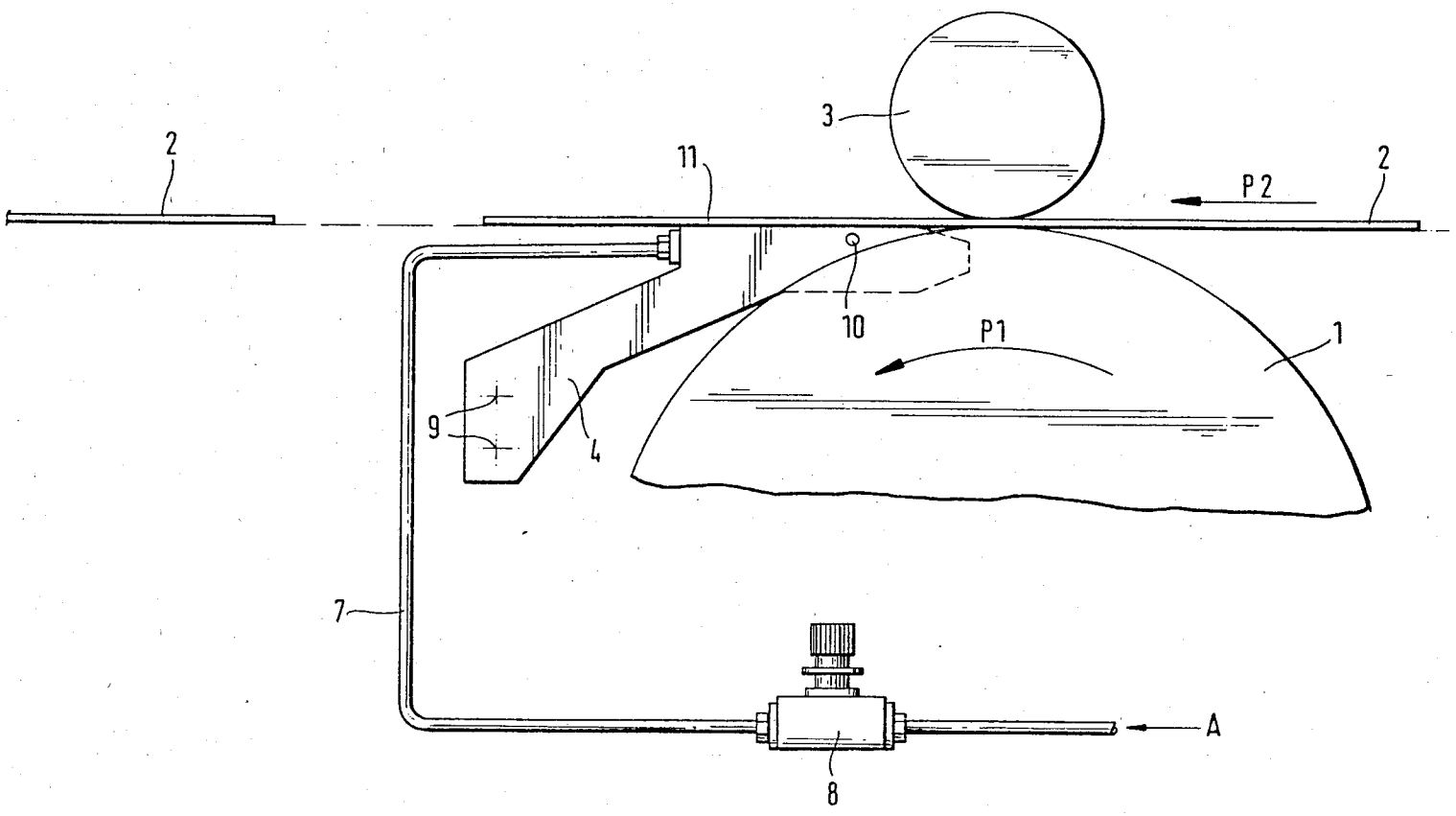
FIG. 1 is a side view of a strip-gluing unit with air-guide members.

The strip-gluing unit of a folding box forming machine illustrated in FIG. 1 comprises a gluing disc 1, which is immersed in a glue bath which is not shown and rotates in the direction of arrow P1. The glue sticks to the gluing disc 1 by adhesion, is metered by doctor blades which can be regulated (not shown) and is transferred to the cardboard blanks 2 travelling in the direction of arrow P2. Located above the gluing disc 1 is a freely rotating counter-roller 3, with the purpose of supporting the travelling cardboard blanks, so that as they travel the blanks cannot be deflected upwards and thus a coating of uniform thickness is ensured.

Figure 2:
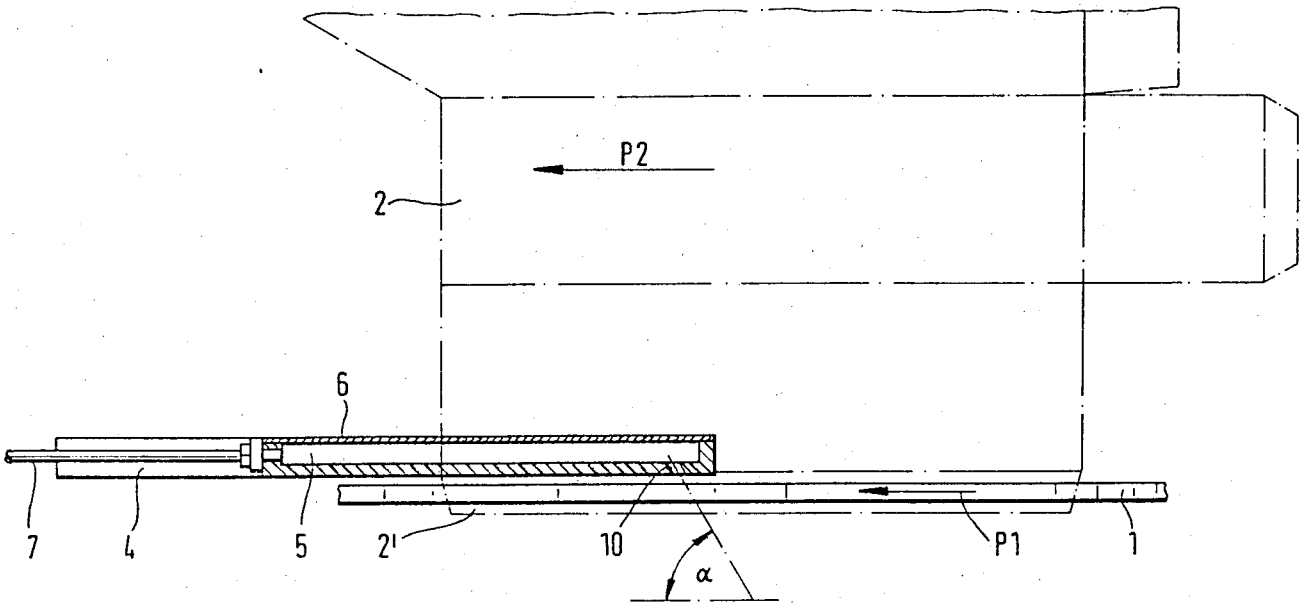
FIG. 2 is a plan view of the strip-gluing unit.

As shown in FIG. 2, it is the purpose of the strip-gluing unit to glue adhesive flaps 2' of the blanks 2.

As known, the blanks are then folded several times in the folding box sticking machine, until the adhesive flaps 2' are stuck to the opposite sides of the blanks 2. In this way folding boxes are produced which lie flat and for filling are erected in a tubular manner and with the base or top parts being sealed.

Figure 3:
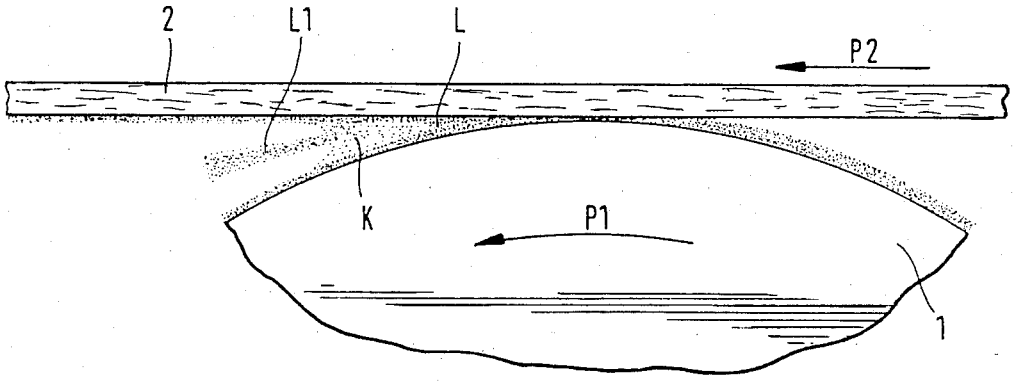
FIG. 3 is an enlarged view of the nip between the gluing disc of the strip-gluing unit and a cardboard blank.

FIG. 3 shows the processes which normally take place during the transfer of glue in the gusset between the gluing disc 1 and cardboard blank 2.

As a result of adhesion, an upper branch of the glue L remains stuck to the blank 2 and continues on its way together with the latter. For the same reason, another branch remains stuck to the gluing disc 1 and follows the circular path of the gluing disc 1.

From the geometry of the paths of movement of the blank and gluing disc, it results that the glue L in the nip is split up and a wedge-shaped area K is produced, in which an association of the particles of glue with the upper or lower branch is uncertain. The result is glue droplets L1, which on account of the high speed of the blank and gluing disc are thrown in the direction P1/P2.

However, droplets of glue in the form of splashes are undesirable in folding box forming machines and one must strive not to allow these to contaminate the apparatus. For this purpose the following apparatus was developed: it consists of an air-guide member 4, which is milled out to form an air-chamber 5, which is covered by a cover plate 6. Connected to this milled-out portion is an air line 7, which is supplied by a source of compressed air A which is not shown. A pressure-regulating valve 8 is incorporated in the line 7. The air-guide member 4 is adjustably attached by screws 9 independently of the strip-gluing unit in the folding box forming machine.

Leading from the air chamber 5 of the air-guide member 4 is a bore 10, which is directed obliquely towards the direction of movement of the blank and gluing disc and in particular at an angle between 40° and 70°. The direction of the bore is such that the air stream is directed with a component opposed to the direction of movement of the blank and gluing disc. In this way the droplets of glue are moved away at right angles to the direction of travel, i.e. on the shortest path. In order that they are able to take the shortest path towards the outside, the air-guide member 4 is located on the side of the gluing disc 1 remote from the adhesive flap 2'. Furthermore, the air-guide member 4 has a smooth surface 11, which is constructed as a support surface for the travelling blanks 2.

It will be appreciated that the instant specification and claims are set forth by way of illustration and not limitation, and that various modifications and changes may be made without departing from the spirit and scope of the present invention.

What is claimed is:

1. In a method for gluing folding boxes including immersing a gluing disc in a glue bath having a gluing surface and two main sides perpendicular thereto and rotating same about an axis of rotation, metering the glue sticking to the gluing surface of the gluing disc and conveying flaps of folding box blanks over the gluing disc in a conveying direction perpendicular to the axis rotation to define a nip between the blanks and the gluing disc wherein a wedge-shaped area is formed between the layer of glue adhering to the blank and the layer of glue adhering to the disc, the improvement comprising blowing compressed air at the height of the nip between the gluing disc and the blank and into the wedge-shaped area of the layers of glue adhering to the gluing disc and the blank from a source at one main side of the gluing disc directing said compressed air to the other main side.

2. The method according to claim 1, wherein the compressed air is blown at an acute angle with respect to said one main side and with a component opposite the conveying direction of the blanks.

3. In a strip gluing apparatus for a folding box forming machine, including a rotatable gluing disc having an axis of rotation, a gluing surface around the axis of rotation and two main sides perpendicular to the axis of rotation and immersible in a glue bath for adhering glue to the gluing surface, and means in said apparatus for conveying flaps of folding box blanks past the disc in a conveying direction perpendicular to the axis of rotation and with the disc therebelow to define a nip between the gluing disc surface and the blank with a wedge shaped area formed by layers of glue adhering to the gluing surface of the disc and the glue adhering to the blank, the improvement comprising means for blowing compressed air at the height of the nip and into the wedge-shaped area from a source at one main side of the gluing disc directing said compressed air to the other main side.

4. The apparatus according to claim 3, wherein the blowing means comprises an air-guide member arranged laterally beside the one main side of the gluing disc and having a blowing aperture directed at the height of the nip.

5. The apparatus according to claim 4, wherein the air-guide member comprises a plate and an air chamber connected to a source of compressed air, means forming a bore in the air chamber directed from the one main side towards the wedge-shaped area at an acute angle with the conveying direction of the blank to form a component of the air stream which is directed in opposition to the conveying direction of the blank.

6. The apparatus according to claim 5, wherein the acute angle is between 40° and 70°.

7. The apparatus according to claim 4, further comprising means adjustably attaching the air-guide member to the side of a folding box forming machine independently of the remainder of the strip gluing apparatus and on a main side of the gluing disc which is remote from the flap of the blank.

8. The apparatus according to claim 4, wherein the air-guide member has a smooth surface for supporting blanks being conveyed.

* * * * *